United States Patent [19]

Christensen

[11] 4,028,743

[45] June 14, 1977

[54] PROTECTIVE HEAD-WEAR

[76] Inventor: Cai V. Christensen, 8426 Pinelake Drive, Canoga Park, Calif. 91304

[22] Filed: Aug. 4, 1975

[21] Appl. No.: 601,782

[52] U.S. Cl. ..... 2/424; 2/9

[51] Int. Cl.[2] ..... A42B 1/08

[58] Field of Search ..... 2/3 R, 9, 424

[56] References Cited

UNITED STATES PATENTS

| | | | |
|---|---|---|---|
| 2,686,912 | 8/1954 | Shipman | 2/9 |
| 2,860,343 | 11/1958 | Aileo | 2/9 |
| 3,050,736 | 8/1962 | Malcom | 2/9 |
| 3,263,236 | 8/1966 | Humphrey | 2/9 |
| 3,729,746 | 5/1973 | Humphrey | 2/9 |
| 3,854,146 | 12/1974 | Dunning | 2/9 |
| 3,900,897 | 8/1975 | Dunning | 2/9 |

*Primary Examiner*—Alfred R. Guest

*Attorney, Agent, or Firm*—Nilsson, Robbins, Dalgarn & Berliner

[57] ABSTRACT

A protective head-wear including a shell or helmet-like member for protecting the head of a wearer and a face shield of the full face protective type. The face shield may be constructed of a transparent member such as a solid clear plastic or alternatively of wire mesh. In either event, about the peripheral edge of the face shield there is provided a rim which may be constructed of a separate wire or may be formal integrally with the shield. Shock absorbing resiliently deformable means is disposed between the face shield and the shell to absorb forces applied to the face shield as a result of impact thereon. The resiliently deformable member may be a rubber-like strip secured to the periphery of the forward edge of the helmet and engagable by the rim on the face shield. Alternatively, the shock absorbing member may be resiliently deformable member incorporated into a means for attaching the face shield to the shell.

24 Claims, 13 Drawing Figures

FIG.1.
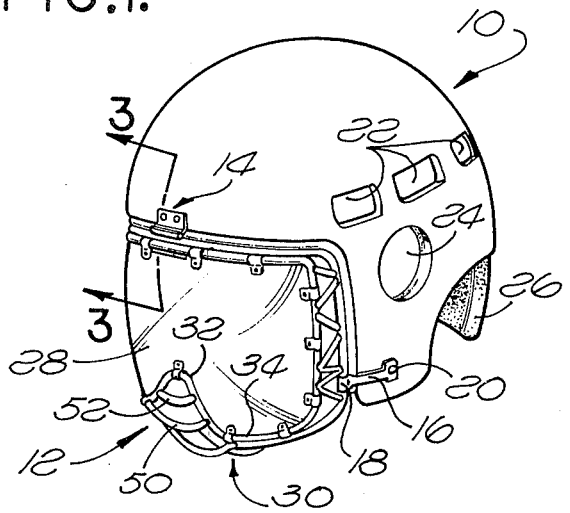
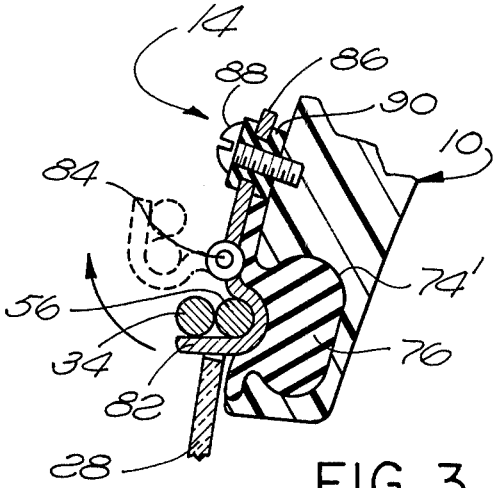
FIG.3.
FIG.2.
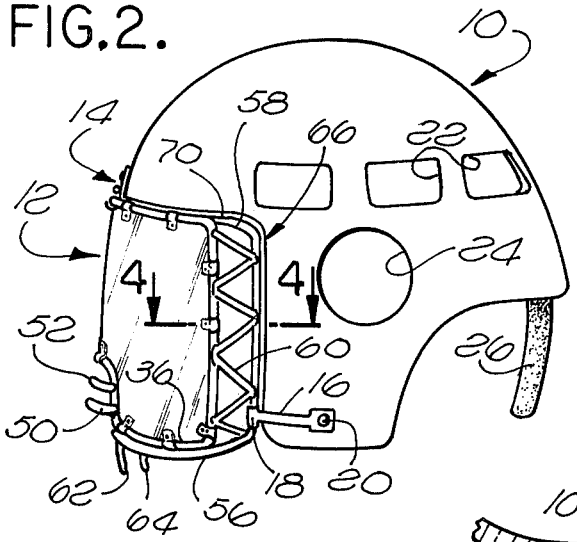
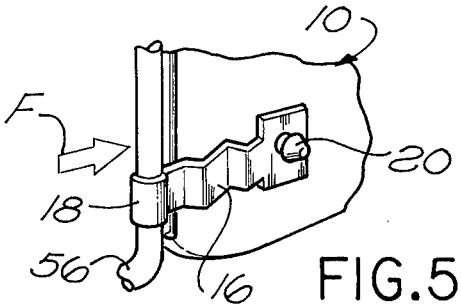
FIG.5.
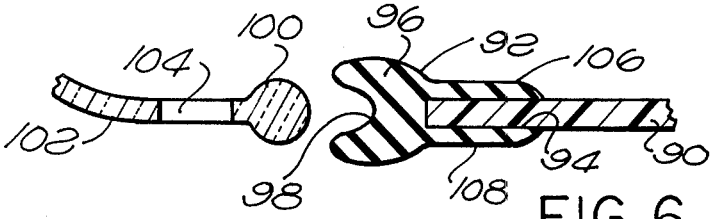
FIG.6.
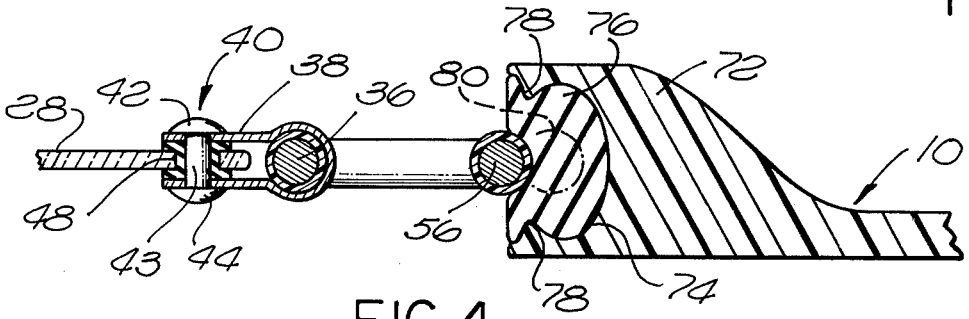
FIG.4.

FIG. 7.
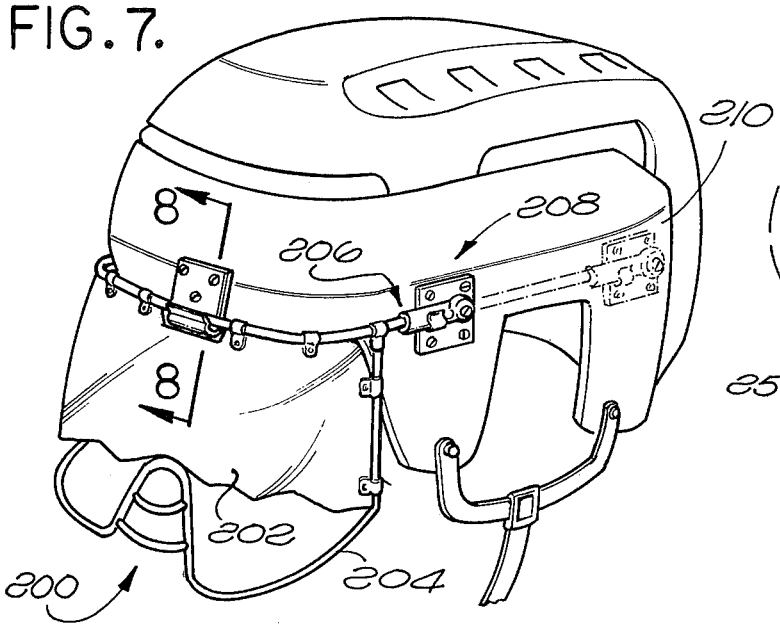
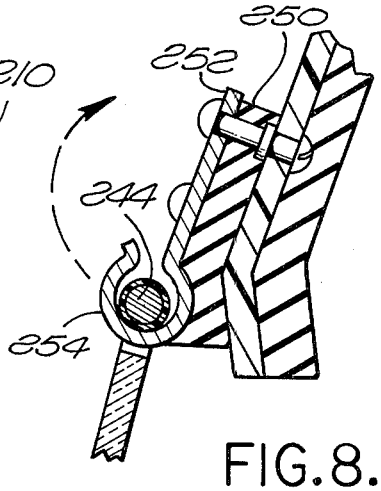
FIG. 8.
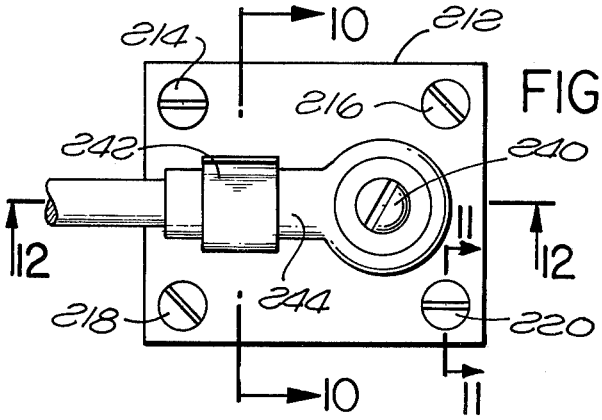
FIG. 9.
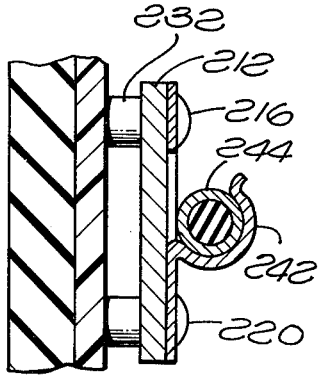
FIG. 10.
FIG. 12.
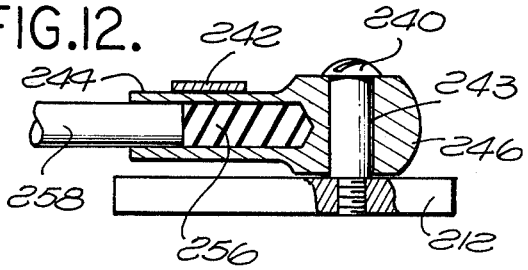
FIG. 11.
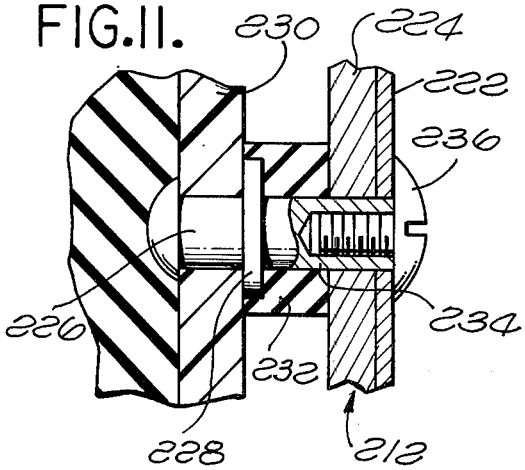
FIG. 13.
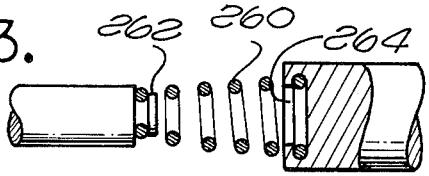

PROTECTIVE HEAD-WEAR

BACKGROUND OF THE INVENTION

In recent years, particularly in various sports activities, it has become generally accepted that protective headgear is desirable. For example in sports such as LaCrosse, football, motorcycling, ice hockey, mountain climbing, skiing and the like. Such headgear is often worn by those participating therein. In some instances such headgear has been made mandatory. The reasons for the wearing of such headgear by the participants in the sports is to protect against injury to the head of the wearer which may be imparted by other participants in the sport or alternatively by foreign objects falling upon the head of the participant or the participant falling and coming into contact with hard objects which can impart damage to the head. In many of the sports where protective headgear is already worn, there has developed a recent awareness of the need for full face protection of the wearer as well. Such awareness has resulted particularly in sports such as LaCrosse, football and ice hockey through greater participation, particularly by juveniles at an earlier age in the sport. Under these circumstances, injuries to the participants are recorded and results of these injuries are more easily brought to the attention of a greater number of people. Usually these injuries are imparted by others participating in a particular sport, such for example by sticks and pucks, used in the game of ice hockey, by the ball and sticks used in the game of LaCrosse and by various parts of the body of others in the game of football. In motorcycling, typically rocks or other debris are thrown into the face of the motorcyclist by other vehicles in the near vicinity. In any event, prior art attempts have resulted in certain types of full face protection.

Full face protection of the prior art has resulted in wire cages which are typically utilized by football players and ice hockey players, in some instances by LaCrosse players. In addition, some ice hockey players and motorcyclists have adopted the utilization of a full face transparent shield.

In either event in the prior art whether wire cages or transparent shields are utilized, certain disadvantages have resulted. These full face protective shields are affixed solidly to the helmet which is utilized to protect the head of the wearer. As a result forces imparted to the face shield from whatever source are transmitted directly to the head of the wearer through the suspension system utilized to connect the face shield to the helmet. In addition thereto, where wire cages are utilized, the openings therein are such that foreign objects used in the sport such as the end of the stick, the puck or a part of the ball can project through the opening and engage the face of the wearer thus still imparting damage of an undesired nature.

When the transparent full face shields are utilized in ice hockey or motorcycling, it has been noted that a fogging of the intersurface thereof occurs thus making it difficult for the wearer to be able to easily see at all times during the conduct of the sport. Many antifogging compounds have been attempted to overcome this problem but thus far none have been found that are totally effective under all circumstances or that have a long lasting affect. In addition thereto, in many instances where a full face protective device is desirable and where a sport is being conducted, it is desirable for the participants in the sport to be able to easily talk to each other. Where a full face, solid, transparent shield such as that made of plastic is utilized, the participant has great difficulty in talking in that such difficulty results from the fact that the player hears himself as if he were talking in a well. Also the voice is difficult to project to others participating in the sport nearby.

SUMMARY OF THE INVENTION

Protective head-wear including shell means and face shield means for protecting the head and face of the wearer respectively. Resiliently deformable means is disposed between the face shield and the shell means and is gaged by both the shell and the face shield for absorbing a portion of the shock imparted to the face shield when a blow is imparted thereto. In a more specific aspect of the invention, the resiliently deformable means is a soft, rubber-like substance affixed about the forward periphery of the shell and against which the peripheral edge of the face shield rests so that upon a blow being received by the face shield, the soft, rubber-like substance compresses and absorbs a substantial portion of the force generated by the blow and thus precludes the transmission thereof to the head of the wearer.

Alternatively, in accordance with another specific aspect of the present invention, the resiliently deformable means may include shock absorbing material incorporated directly into means for attaching the face shield to the shell.

Where the face shield is constructed of a solid, transparent plastic material, a recess is provided therein about the wearer's mouth and nose to preclude fogging and to enable the player to freely talk to others.

In accordance with the further aspect of the invention a full face shield and shock absorbing material may be affixed to existing helmets.

BRIEF DESCRIPTION OF THE DRAWINGS

FIG. 1 is a perspective view of a combined helmet and face shield constructed in accordance with the principals of the present invention;

FIG. 2 is a left side elevation of the protective head-wear disclosed in FIG. 1;

FIG. 3 is a cross-sectional view taken about the lines 3—3 of FIG. 1 and illustrating the pivotal attachment of the face shield to the helmet;

FIG. 4 is a cross-sectional view taken about the lines 4—4 of FIG. 2 and illustrating one form of the shock absorbing material and its cooperative relationship with the face shield;

FIG. 5 is a fragmentary view of one portion of the protective head-wear system of the present invention illustrating its operation when a blow is imparted to the face shield;

FIG. 6 is a fragmentary cross-sectional view similar to that of FIG. 4 and illustrating an alternative arrangement for the shock absorbing material used in accordance with the principals of the present invention;

FIG. 7 is a perspective view illustrating an alternative embodiment of a protective head-wear constructed in accordance with the features of the present invention and particularly illustrates a system enabling the attachment a full face shield to an existing helmet;

FIG. 8 is a fragmentary cross-sectional view taken about the lines 8—8 of FIG. 7;

FIGS. 9 through 12 illustrate a preferred embodiment of the means for attaching the full face shield to an existing helmet; and FIG. 13 illustrates an alternative embodiment of a shock absorbing means which may be utilized.

DETAILED DESCRIPTION OF THE INVENTION

In accordance with the present invention there is provided a full head-face protective system which incorporates shock absorption means to cushion the forces generated by blows to the full face protective shield provided. The protective head-wear system constructed in accordance with the principals of the present invention may be utilized in a multiplicity of sports, such as LaCrosse, football, motorcycling, ice hockey, mountain climbing, skiing and many others or alternatively may be utilized by persons engaged in police or military work wherever protective head-wear is required. In any event and for purposes of illustration only, the protective head-wear system in accordance with the present invention will be described in conjunction with the game of ice hockey.

The reason for choosing ice hockey as an illustrative example for description of the protective head-wear system in accordance with the present invention is that it represents situations normally encountered by all other wearers of the head gear respective of the sport or reason for wear thereof.

Referring now to FIGS. 1 through 6 there is illustrated a preferred embodiment of a protective head-wear system constructed in accordance with the present invention as is shown particularly in FIG. 1. There is provided a shell 10 to which there is affixed a face shield means 12. The face shield 12 may be pivotally attached to the shell means 10 by means of a hinge 14. When properly positioned upon the head of a wearer the face shield may be secured by means of a strap 16 which is secured at one end 18 to the face shield 12 and at the utter to a snap, lug, or similar attachment means secured to the shell 10.

The shell 10 is constructed of any material desired such as fiberglass, poly-carbonate plastic, poly-vinyl chloride or the like as is well known to the prior art. The shell 10 includes air holes 22 to provide ventilation about the head of the wearer and an ear hole 24 to permit the wearer to hear conversations from others on the ice such as his team mates or opponents. As is well known provided inside the shell 10 is a protective padding usually constructed of sponge rubber or the like which is covered by fabric or formed with an integral protective layer. An extension of such fabric is illustrated at 26 and is designed to extend down over and protect the back of the neck of the wearer of the protective head-wear constructed in accordance with the present invention.

The full-face protective shield means constructed in accordance with the principles of the present invention may be constructed totally of a wire mesh type of structure if such is desired. However for purposes of the illustration of the preferred embodiment in accordance with the present invention a composite structure consisting of a solid transparent member 28 having a frame 30 thereabout is shown and will be described. It will of course be recognized by those skilled in the art that the full-face shield may be made totally of a transparent solid plastic material such as poly-carbonate if such is desired.

A sheet of poly-carbonate plastice after being formed is heated and draped over a mold having the desired shape to form it to comply with the general contour such that the inside of the face shield 28 will be spaced slightly beyond the nose of the wearer of the protective head-wear. A recess 32 is formed in the lower surface 34 of the transparent member 28. The recess provides an opening to permit the respiration of the wearer whether expelled forcibly through the nose or through the mouth as will occur during extended hard skating. To be expelled into the atmosphere as opposed to being captured internally of the transparent shield 28. The recess 32 also provides an opening so that when the wearer of the protective head-wear attempts to talk to his team mate the voice can escape and will be heard by the player as being more natural.

The frame or rim 30 is constructed preferably of a rod-light member 36 which may be constructed of any material desired such as plastic or a plastic coated wire. For purposes of this description it will be assumed that the member 36 is constructed of a plastic coated wire. The plastic shield 28 is affixed to the wire 36 through the utilization of a plurality of attachment means such as plastic clips 38 which surround the wire frame 36 and are secured to the transparent plastic shield 28 by a rivet-screw combination 40 which is well known in the art and includes a rivet having a head 42 and a hollow shank 43 which is internally threaded with a screw 44 threadily received therein. A rubber grommet 46 is disposed within an opening 48 provided in the transparent plastic plate 28 and which is used to absorb shocks that may otherwise be transmitted to the plate 28 causing a cracking or crazing thereof. The openings 48 are provided preferably through the utilization of high speed drills to preclude crazing or cracking of the poly-carbonate plastic. It will be recognized by those skilled in the art that through the utilization of the attaching system and particularly the rivet means such as at 40 the poly-carbonate plastic 28 can be replaced from time to time within the wire frame 36 should such be desired as a result scratching, cracking, crazing or the like which would result during normal wear and tear of a protective head-wear system constructed in accordance with the present invention.

To protect the nose and mouth of the wearer rigid members 50 and 52 are connected to each end thereof to the wire frame 34 and extend across the recess 32 to preclude entry of foreign objects therethrough and into contact with the face of the wearer but without interfering with the breathing of the wearer or his ability to speak through the full-face shield means.

The rod-like means adjacent the periphery of the transparent member 28 also includes a rod 54 which may be constructed of any material desired such as plastic or a plastic coated wire as was the case with respect to the frame 36. The rod 54 is affixed as by welding or the like to the frame 36 and along the side edges thereof adjacent the wearer's face is spaced from the frame 36 to provide an opening 58 enabling circulation of air about the wearer's face. To protect the wearer from foreign objects entering the opening 58, protective members 60 engage the wire frames 36 and 56 to cover the opening 58 but without interfering with air circulation.

To provide submandibular protection for the wearer there is also provided a pair of protective members 62 and 64 which may be formed as a part of the frame 56 or may be attached to thereto as desired. The member 62 and 64 extend beneath the chin of the wearer to provide this desired protection. The ability to utilize such submandibular protective member 62 and 64 is realized through the hinge 14 which enables the entire full face protective shield means to be pivoted forwardly and upwardly enabling the wearer to place the shell 10 upon his head thereafter the full face shield is pivoted down into position with the subsequent locking of the straps 16 to secure it in place.

Provided about the forward peripheral opening 66 of the shell 10 is a resiliently deformable member 70 which is engaged both by the shell 10 and by the rod-like member 56. When a blow is received by the face shield causing a force F as shown in FIG. 5 to be imparted to the face shield 12 the resiliently deformable means 70 gives or compresses as is illustrated by the configuration of the strap 16 shown in FIG. 5. As the frame 56 moves closer to the edge 66 of the shell 10 thus the resiliently deformable means 70 acts as a shock absorber to soften the forces applied by the blow to the face shield means. The forces F then are not transmitted through the protective head gear to the head and neck of the wearer as is the case with prior art apparatus.

One form of affixing the resiliently deformable means to the shell 10 is illustrated in detail in FIG. 4 to which reference is now made. As is therein shown the shell 10 is increased in thickness about its forward edge 72. The increased forward edge 72 defines a recess 74 therein. Received within the recess 74 is a resiliently deformable member constructed from a strip of soft rubber-like substance such as expanded polyurethane foam of high density or the like. The rubber-like substance 74 is formed in such a manner as to provide grooves 76 and 78 therein and thus to be retained within the opening 74 once inserted therein. As a force is exerted upon the face shield 12 the wire frame 54 is depressed within the soft rubber-like substance 76 as is illustrated by the dash line 80 thereby absorbing a good portion of the shock applied to the shield 12 and distributing the same about the entire periphery of the shell 10 against which the rim 56 rests.

Referring now more specifically to FIG. 3 there is illustrated the particular hinging means 14 which interconnects the face shield to the helmet or shell 10. As is illustrated the wire frame 34 and 56 are secured to a first portion 82 of the hinge 14 which is pivoted at the point 84 to the second arm 86 of the hinge. The second arm 86 is secured to the shell 10 by means of a screw 88 or similar structure which passes through a grommet 90 which is constructed of rubber or similar substance to provide shock absorption between the hinge and the helmet as was discussed with respect to FIG. 4. The soft rubber-like substance 76 extends around the top periphery of the helmet 10 and is disposed within the recess 74′ which is a continuation of the recess 74. Through utilization of the pin 84 and the hinge plate 82, forces imparted to the upper portion of the full face shield 12 will be absorbed and distributed through the rubber-like member 76 as described below.

Referring now to FIG. 6 there is shown in fragmentary cross-sectional view an alternative embodiment of a shock absorbing portion of the system constructed in accordance with an alternative embodiment of the present invention. As is shown in FIG. 6, there is provided a system particularly useful in adapting helmets already worn by hockey players to the shock absorbing system utilizing a full face shield in accordance with the principles of the present invention. As is illustrated in FIG. 6, an existing helmet will include a peripheral edge 90 which is relatively thin and thus incapable of being formed with a recess to receive the soft rubber-like resiliently deformable strip. As a result, the resiliently deformable strip will be constructed as generally shown at 92 and will include a groove 94 within which is received the edge 90 of the helmet. The member 92 is enlarged as shown at 96 and may be define a recess 98 having a complimentary configuration to a bead 100 formed about the periphery of a transparent plastic face shield 102 as is illustrated openings 104 are provided along the edge of the face shield to provide circulation about the face of the wearer. In use, the bead 100 would be inserted into the recess 98 thus assisting in securing and retaining the face shield to helmet. Again when forces are imparted to the face shield 102, the member 92 gives and absorbs the shock and distributes the same along the entire front area 90 of the helmet as has been above described. As will be appreciated when affixing the member 92 to the front edge 90 of the helmet adhesive may be utilized to secure the same in place and reinforcing material may be utilized in the lips 106 and 108 defining the recess or slot 94.

Referring now to FIGS. 7 through 13, an alternative embodiment of a protective head wear system having shock absorbing capabilities in accordance with the principles of the present invention is illustrated. This configuration is particularly adapted for utilization with existing helmets having insufficient front periphery to receive shock absorbing member as illustrated in FIG. 6. As a result, the shock absorbing members of the configuration as shown in FIG. 7 through 13 are incorporated into that portion of the system which enables affixing the full face shield to the helmet. Thus in accordance with the alternative embodiment of the invention as illustrated in FIGS. 7 through 13 a full face shield 200 of construction similar to that above described is provided. Such includes a transparent plastic member 202 surrounded by a rod-like structure or frame 204. Extending from the frame 204 are arms one of which is shown at 206 for attachment by attaching 208 to the side of the helmet as illustrated in FIG. 7. Should such be desired, the attachment means 208 may be moved to the rear portion of the helmet as is illustrated by the dash lines 210. Such movement would preclude the placement of the various metallic pieces securing the attachment means 208 to the side of the helmet away from the temple area of the wearer.

The attachment means 208 includes a pair of plates; one attached to each side of the helmet and one of which is illustrated at 212. The plate 212 is secured by screws dash rivets combinations 214 through 220. Such combinations are illustrated more clearly FIG. 11 wherein it is shown that the plate 212 includes a metallic member 222 having a layer of resiliently deformable material 224 of the type above specified bonded thereto. A rivet 226 having a spacing washer 228 is affixed to the helmet 230. An appropriate grommet 232 is inserted over the shank 234 of the rivet after which the plate 212 is positioned and a screw 236 is then inserted in place and tightened. By this construction it will be recognized that any forces which are applied to the plate 212 will be absorbed by the grommet 232 and the resiliently deformable means 224.

The arm 206 is pivotally attached to the plate 212 by means of a screw 240 which passes through an opening 243 in the enlarged end 246 of arm 206. A clip means is employed at both sides and at the front to preclude the shield 200 from being pulled downwardly beyond the desired predetermined position. A clip means may be include a spring clip 242 secured to the metal plate 222 and may for example be formed by striking the same therefrom to thus provide effectively a U-shaped configuration within which a tubular portion 244 of the arm 206 is received. It will be noted that the distance between the upper portion of the terminus of the spring clip 242 and the edge of plate 222 is less than the dimension across the tubular member 244 thus some force of a predetermined nature is required to lift the tubular member 244 from engagement with the clip 242. As a result, the face shield 200 will be rotated upwardly about the pivot member 240 only when a predetermined force is applied thereto; such as, for example, when the player himself wishes to raise the face plate to position the helmet or when an extreme force is applied thereto and the face shield needs to be lifted for safety purposes. A similar structure is provided at the top front of the helmet as is illustrated more particularly in FIG. 8 and as can be seen includes the shock absorbing resiliently deformable material 250 to which a plate 252 is bonded. The lower portion of the plate is formed into a U-shaped clip 254 into which the rod-like member 204 is received. Again the dimensions are such that a predetermined force must be exerted to cause the spring member 254 to open sufficiently to permit the rod-like 204 to pass therethrough. The plate 252 is affixed to the helmet in the same manner as is illustrated in FIG. 11.

Additional shock absorbing capability is provided the structure as shown in FIG. 7 through 13 by providing a resiliently deformable member in the arm 206. By reference specifically to FIG. 12, one form of such structure is shown. As is therein illustrated the tubular member 244 has a raised resiliently deformable plug 256 inserted within the opening thereof. The arm 206 includes a rod 258 which is then slightably inserted within the opening of the tubular member 244. Sufficient clearance is provided to allow the rod 258 to move within the opening but only upon the application of force thereto. Thus as forces are applied and the rod 258 moves, the plug 256 compresses to assist in absorbing the shock and distributing the same along with the remainder of the shock absorbing system as above described.

Alternatively, the tube and plug configuration as described in FIG. 12 may be replaced by a resiliently deformable member constructed as a spring 260 as illustrated in FIG. 13. As is therein shown the spring 260 is inserted over a protrusion 262 defining appropriate groove and a keeper plate to retain the same in position. The opposite end of the spring is inserted within an opening 264 and is held in place therein by an appropriate groove. As forces are applied, the spring 260 will compress to receive the same as opposed to allowing them to be transmitted directly to the head of a wearer of the protective head-wear system constructed in accordance with principles of the present invention.

As more readily recognized by those skilled in the art a shock absorbing protective head wear system constructed in accordance with the present invention may be applied to existing helmets through utilization of the configuration as shown in FIG. 6 or FIG. 7 through 13 as may be desired depending upon the particular helmet involved. It will also be recognized that the configuration of the full face shield as illustrated in FIGS. 1 through 4 may be utilized in conjunction with the resiliently deformable member as shown in FIG. 6 while the shield as shown in FIG. 6 and illustrated at 102 may be substituted for the shield as illustrated in FIGS. 1 through 4.

There has thus been disclosed a protective head-wear system utilizing a full face shield means which is attached to a protective head shell by means of a shock absorbing system employing resiliently deformable means. Receiving, absorbing, and distributing the forces generated by blows to the face shield throughout the head-wear system while providing ability for the wearer to talk, breathe and retain some comfort through air circulation about his face.

What is claimed is:

1. Protective head-wear comprising:

1. shell means for covering a substantial portion of the head of a wearer and having a peripheral edge adjacent to and extending along the face area of a wearer;
2. face shield means for covering a substantial portion of the face of a wearer and having a peripheral side edge portion; and
3. a soft rubber-like resiliently deformable means defining a slot therein, said peripheral edge of said shell means being received within said slot, said rubber-like means being engaged by said peripheral side edge portion of said face shield means for absorbing a portion of the shock imparted to said face shield means by a blow thereto.

2. Protective head-wear comprising:

1. shell means for covering a substantial portion of the head of a wearer and having a peripheral edge adjacent to and extending along the face area of a wearer;
2. face shield means for covering a substantial portion of the face of a wearer and having a peripheral side edge portion defining a rim means thereabout; and
3. a soft rubber-like resiliently deformable means secured to said peripheral edge of said shell means and engaged by said rim means of said face shield means for absorbing a portion of the shock imparted to said face shield means by a blow thereto.

3. Protective head-wear as defined in claim 2 wherein said rubber-like means defines a recess therein and said rim means fits within said recess.

4. Protective head-wear comprising:

1. shell means for covering a substantial portion of the head of a wearer and having a peripheral edge adjacent to and extending along the face area of a wearer;
2. face shield means including a transparent member of impact resistant material for covering a substantial portion of the face of a wearer;
3. a rod-like means adjacent the periphery of said transparent member;
4. means for affixing said transparent member to said rod-like means; and
5. a soft rubber-like resiliently deformable means secured to said peripheral edge of said shell means and engaged by said rod-like means affixed to said face shield means for absorbing a portion of the shock imparted to said face shield means by a blow thereto.

5. Protective head-wear as defined in claim 4 wherein said rod-like means surround said transparent member.

6. Protective head-wear defined in claim 5 wherein said that portion of said transparent member adjacent the lower portion of a wearer's face defines a recess providing an open area to permit a wearer to freely talk to others.

7. Protective head-wear as defined in claim 6 which further includes spaced apart rigid members bridging said recess to preclude entry of large foreign objects therethrough.

8. Protective head-wear as defined in claim 5 which further includes submandibular protector means affixed at each end thereof to said rod-like means and extending under the chin of a wearer.

9. Protective head-wear as defined in claim 5 wherein said rod-like means adjacent each side of a wearer's face defines an opening providing air circulation about the face of the wearer, and spaced apart protectors bridging said opening to preclude entry of foreign objects therethrough.

10. Protective head-wear as defined in claim 4 wherein said means for affixing said transparent member to said rod-like means is removable thereby enabling replacement of said transparent member.

11. Protective head-wear as defined in claim 4 wherein said means for affixing further includes stop means for preventing downward movement of said face shield means beyond a predetermined point when on a wearer.

12. Protective head-wear as defined in claim 11 wherein said stop means includes a clip means.

13. Protective head-wear as defined in claim 12 wherein said clip means is constructed of spring material in U-shaped form and said rod-like means is inserted within said clip means into engagement with the light of said u when in position on the head of a wearer.

14. Protective head-wear as defined in claim 13 wherein the distance between the outer edges of the arms of said U-shaped part of said clip means is less than the width of said rod-like means thereby requiring a predetermined amount of force to pivot said face shield upward.

15. Protective head-wear as defined in claim 11 wherein said means for affixing further includes first and second plates, one secured to each side of said shell means, said stop means including first and second clips affixed to said first and second plates respectively.

16. Protective head-wear comprising:

1. shell means for covering a substantial portion of the head of a wearer and having a peripheral edge adjacent to and extending along the face area of a wearer;
2. face shield means including a transparent member of impact resistant material for covering a substantial portion of the face of a wearer;
3. a rod-like means adjacent the periphery of said transparent member;
4. means for affixing said transparent member to said rod-like means;
5. means for pivotally attaching said face shield means to said shell means; and
6. a soft rubber-like resiliently deformable means secured to said peripheral edge of said shell means and engaged by said rod-like means affixed to said face shield means for absorbing a portion of the shock imparted to said face shield means by a blow thereto.

17. Protective head-wear as defined in claim 16 wherein said means for pivotally attaching includes first and second plates, one secured to each side of said shell means.

18. Protective head-wear as defined in claim 17 which further includes arms extending from said rod-like means to said first and second plates.

19. Protective head-wear as defined in claim 18 wherein said resiliently deformable means is incorporated into said means for pivotally attaching.

20. Protective head-wear as defined in claim 19 which further includes tubular means, a resiliently deformable plug means disposed within said tubular means, said arm positioned to engage said plug means.

21. Protective head-wear as defined in claim 20 which further includes resiliently deformable washers disposed between said first and second plates and said shell means.

22. Protective head-wear comprising:

1. a shell for covering a substantial portion of the head of a wearer and having a peripheral edge adjacent the face of the wearer;
2. a strip of resiliently deformable material affixed along said peripheral edge of said shell; and
3. a full face shield pivotally attached to said shell and including:
   a. a transparent member of plastic material,
   b. a wire frame surrounding said transparent member and engaging said strip of resiliently deformable material, and
   c. fastener means removably attaching said transparent member to said frame.

23. A protective face shield assembly for attachment to a helmet having a front peripheral edge adjacent the face of a wearer comprising:

1. a plate of transparent impact resistant material;
2. a rim surrounding said plate;
3. fastener means removably securing said plate to said rim;
4. hinge means for pivotally securing said plate to said helmet; and
5. resiliently deformable means for attachment to said helmet to absorb forces generated by blows to said plate.

24. A protective face shield assembly as defined in claim 23 wherein said resiliently deformable means is a strip of material defining a slot therein, for receiving said peripheral edge of said helmet, said rim engaging said strip.

* * * * *